United States Patent [19]

Chang et al.

[11] Patent Number: 4,480,025

[45] Date of Patent: Oct. 30, 1984

[54] WATER RESERVOIR LAYERS IN BLEACH-FIX SHEETS

[75] Inventors: Hao J. Chang, Santa Clara, Calif.; Gerhard Popp, Webster; Patrick H. Saturno, Rochester, both of N.Y.

[73] Assignee: Eastman Kodak Company, Rochester, N.Y.

[21] Appl. No.: 457,804

[22] Filed: Jan. 13, 1983

[51] Int. Cl.[3] ..... G03C 5/54; G03C 1/40; G03C 5/38

[52] U.S. Cl. ..... 430/206; 430/213; 430/215; 430/236; 430/237; 430/393; 430/404; 430/418; 430/460

[58] Field of Search ..... 430/206, 215, 213, 237, 430/393, 460, 461, 418, 404, 236, 238, 376, 390, 497

[56] References Cited

U.S. PATENT DOCUMENTS

| | | | |
|---|---|---|---|
| 3,179,517 | 4/1965 | Tregillus et al. | 430/404 |
| 3,414,411 | 12/1968 | Michel et al. | 430/390 |
| 3,647,464 | 3/1972 | Smith et al. | 430/404 |
| 3,709,690 | 1/1973 | Cohen et al. | 430/213 |
| 3,958,995 | 5/1976 | Campbell et al. | 430/213 |
| 4,256,826 | 3/1981 | Popp et al. | 430/213 |

FOREIGN PATENT DOCUMENTS 1330524 9/1973 United Kingdom .

*Primary Examiner*—Richard L. Schilling
*Attorney, Agent, or Firm*—Arthur H. Rosenstein

[57] ABSTRACT

A bleach-fix sheet for use in color photographic processes comprises a support having thereon a bleach-fix layer and a water reservoir layer comprising a water-supplying polymer. In a preferred embodiment, the bleach-fix sheet is useful to bleach and fix a retained image in a color image diffusion transfer process.

24 Claims, No Drawings

WATER RESERVOIR LAYERS IN BLEACH-FIX SHEETS

BACKGROUND OF THE INVENTION

This invention relates to a bleach-fix sheet useful in bleaching and fixing an element containing a silver image and a color-providing material so that the resulting element contains only colorant imagewise. The bleach-fix sheet contains a bleach-fix layer or layers comprising a bleaching agent, a fixing agent and a hardened hydrophilic binder, and a water reservoir layer comprising a water-supplying polymer having a water uptake of at least about 30 g water/g polymer.

In the field of rapid access color photography which is directed to the transfer of a colorant imagewise from one layer or element to another receiving layer or element, the color image is provided by a process wherein the colorant or color former is released from a donor layer or element in imagewise fashion and transferred to a receiver layer or element. The image used is the color image in the receiving layer. The donor layer is either removed by peeling or stripping or is retained integrally with the imaged receiver.

Some effort has gone into providing a useful image in photosensitive elements of image-transfer film units. Specifically, the image element, acting as the donor element, comprises a support and one or more silver halide emulsion layers being associated therewith dye image-providing materials, and the receiver element comprises a support containing a dye image-receiving layer. A silver halide developing agent is present in the unit. After the donor element is imagewise-exposed to light, it is brought into contact with a processing composition which causes the colorant or color former to diffuse either in the imaged or non-imaged areas from the donor to the receiver element. The donor element is used by peeling it from the receiving layer and bleaching the silver and fixing the remaining silver halide to leave only colorant or color formers in the imaged or non-imaged areas. Thus, the image used is the retained image in the donor layer or element.

A problem with the above, particularly in instances where the final color image is produced in this initially light-sensitive element, is the need to remove the developed silver image and the residual silver halide. A method employed in the prior art is to bleach and fix the exposed and developed element comprising the bleach-fix sheet as described in Popp et al, U.S. Pat. No. 4,256,826, issued Mar. 17, 1981. This method uses an aqueous alkaline activator solution to activate the retained image process. In most instances, however, particularly in the so-called soak-and-laminate method, an incompletion of the process has been observed. The reactions and transfer of the undesirable by-products to the bleach-fix cover sheet are not complete, resulting in poor image discrimination. It is theorized that the incompletion is a result of not absorbing sufficient activator solution into the laminated structure. This problem is referred to herein as solution starvation.

British Pat. No. 1,330,524 discloses photographic film units wherein a dessicating layer is used to absorb water. The dessicating process is an irreversible removal of water to terminate or slow down a process. The water reservoir layer of the present invention comprising a water-supplying polymer does not irreversibly remove water.

It has been desirable to provide bleach-fix cover sheets which offer improvements in the processing of color photographic materials and improved image discrimination.

SUMMARY OF THE INVENTION

It has now been discovered, according to the present invention, that improvements result in the efficiency and completeness of simplified color processes utilizing bleach-fix cover sheets when water-supplying polymers having a water uptake of at least about 30 g water/g polymer are incorporated into a water reservoir layer in the bleach-fix cover sheets.

In one embodiment of the invention, a bleach-fix sheet comprises a support having thereon at least one bleach-fix layer for supplying a bleach-fix composition in a photographic element having thereover a water reservoir layer comprising a water-supplying polymer having a water uptake of at least about 30 g water/g polymer, and optionally at least one polymeric timing layer between said bleach-fix layer or layers and said water reservoir layer.

In another embodiment of this invention a photographic film unit containing a silver halide developing agent comprises:

(a) an element comprising a support having thereon at least one photosensitive silver halide emulsion layer having associated therewith a dye image-providing material;

(b) a bleach-fix sheet comprising a support having thereon at least one bleach-fix layer comprising:
  (i) a metallic-silver bleaching agent,
  (ii) a silver salt fixing agent, and
  (iii) a hydrophilic binder, and having over said bleach-fix layer or layers, a water reservoir layer comprising a water-supplying polymer having a water uptake of at least about 30 g water/g polymer; and optionally at least one polymeric timing layer between said bleach-fix layer or layers and said water reservoir layer comprising a water-supplying polymer, and (c) an alkaline processing composition and means for discharging same within said film unit in contact with said photosensitive layer
  wherein, upon discharge of said processing composition, said silver halide is developed imagewise, the developed metallic-silver is bleached, and the silver halide is fixed, leaving a dye image.

In yet another embodiment of the invention, a process of producing a retained image in a photographic film comprises:

(a) treating an imagewise-exposed element comprising a support having thereon at least one photosensitive silver halide emulsion layer having associated therewith a dye image-providing material with alkaline processing solution in the presence of a silver halide developing agent;

(b) imagewise removing the dye from the dye image-providing material from the element by releasing said dye into said processing composition, or by contacting said processed element with an image-receiving element and subsequently removing the image-receiving element; and (c) contacting the element with a bleach-fix sheet comprising a support having thereon at least one bleach-fix layer comprising:
  (i) a metallic-silver bleaching agent,
  (ii) a silver salt fixing agent, and (iii) a hydrophilic binder, said bleach-fix sheet having thereover, a water reservoir layer comprising a water-supplying polymer, said polymer having a water uptake of at least about 30 g water/g polymer, said process optionally comprising soaking said bleach-fix sheet in said processing composition prior to contact with said element.

A further embodiment of the invention is a process of producing a photographic image in a photographic film unit comprising an element comprising a support having thereon at least one photosensitive silver halide emulsion layer having associated therewith a dye image-providing material, said process comprising imagewise exposing said element to radiation, developing the image in a processing composition and treating the developed image with a bleach-fix sheet comprising a support having thereon at least one bleach-fix layer comprising:

(1) a metallic-silver bleaching agent,
(2) a silver salt fixing agent, and
(3) a hydrophilic binder, said bleach-fix sheet having thereover, a water reservoir layer comprising a water-supplying polymer, said polymer having a water uptake of at least about 30 g water/g polymer.

A still further embodiment of the present invention is a process of producing a photographic transfer image in a photographic film unit comprising:

(a) an element comprising a support having thereon at least one photosensitive silver halide emulsion layer having associated therewith a dye image-providing material;
(b) a bleach-fix sheet comprising a support having thereon at least one bleach-fix layer comprising:
  (i) a metallic-silver bleaching agent,
  (ii) a silver salt fixing agent, and
  (iii) a hydrophilic binder, said bleach-fix sheet having thereover, a water reservoir layer comprising a water-supplying polymer, said polymer having a water uptake of at least about 30 g water/g polymer;

(c) an alkaline processing composition and means for discharging same within said film unit in contact with said photosensitive layer wherein the film unit contains a silver halide developing agent, said process comprising:
  (i) imagewise-exposing said film unit to radiation,
  (ii) laminating element (a) to bleach-fix sheet (b) so that the alkaline processing composition permeates element (a) and element (a) is bleach-fixed by bleach-fix sheet (b), and
  (iii) removing the bleach-fix sheet from element (a).

In another embodiment of the present invention, a process of producing a photographic transfer image in a photographic film comprises:

(a) imagewise-exposing a photosensitive element comprising a support having thereon at least one photosensitive silver halide emulsion layer having associated therewith a dye image-providing material;
(b) treating the exposed element with alkaline processing solution in the presence of a silver halide developing agent; and
(c) contacting the element with a bleach-fix sheet comprising a support having thereon at least one bleach-fix layer comprising:
  (i) a metallic-silver bleaching agent,
  (ii) a silver salt fixing agent, and
  (iii) a hydrophilic binder, said bleach-fixing sheet having thereover at least one water reservoir layer comprising a water-supplying polymer, said polymer having a water uptake of at least about 30 g water/g polymer.

DETAILED DESCRIPTION OF THE INVENTION

The bleach-fix sheet of this invention comprises a support having thereon a bleach-fix layer or layers preferably comprising:

(a) a metallic-silver bleach agent,
(b) a silver salt fixing agent, and
(c) a hydrophilic binder, said bleach-fix sheet having thereover a water reservoir layer comprising a water-supplying polymer, said polymer having a water uptake of at least about 30 g water/g polymer.

The water reservoir layer comprising a water-supplying polymer differs from and does not operate as a timing layer. Timing layers such as referred to in U.S. Pat. No. 3,414,411, which comprise gelatin, poly(vinyl alcohol), and poly(vinyl alcohol)-poly(vinyl acetate) mixtures, function as diffusion barriers with time for breakthrough highly dependent on layer thickness, but not on layer composition. The layers swell but do not undergo extensive structural change. Other timing layers undergo extensive structural change through hydrolysis or other reactions. The coatings of water-supplying polymers of the invention maintain their physical integrity and do not operate as timing layers.

As used herein, the term "water reservoir layer" means that the layers of the invention provide water to the adjacent bleach-fix cover sheet during the processing cycle to enhance silver removal and image discrimination. The water reservoir layer must first permit transfer of aqueous activator solution to the bleach-fix cover sheet to solubilize its active components. Secondly, it must permit transfer of these bleaching and fixing components out of the bleach-fix sheet and into the silver halide containing layer or layers. Finally, the byproducts of the bleach-fix reactions are preferably transferred back to the bleach-fix cover sheet.

As used herein, the term "water-supplying polymer" means that the polymers of the invention must be highly effective for water-absorption and must be able to deliver or supply water to the adjacent bleach-fix cover sheet. The effectiveness of the water-supplying polymer is measured by water uptake data. The water uptake of a polymer coating is determined by cutting weighed samples, dipping the samples in water for 10 seconds, and thereafter reweighing the samples to determine water uptake. A water uptake of at least about 30 g water/g polymer is required to enhance silver removal and image discrimination and prevent solution starvation.

The polymers of the invention include those having a water uptake of at least about 30 g water/g polymer. A preferred class of water-supplying polymers comprises:

(1) from about 10 to about 70 percent by weight of recurring units having formulas selected from the group consisting of:

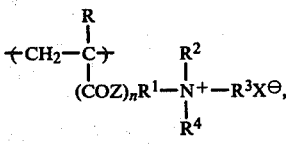

(I)

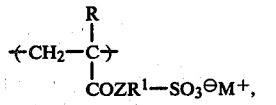

(II)

and mixtures of I and II, wherein:

R is hydrogen, methyl or halogen such as bromo or chloro;

Z is oxy or imino;

n is 0 or 1;

$R^1$ is alkylene including substituted alkylene preferably having from 1 to 6 carbon atoms, such as methylene, ethylene, propylene, 2-hydroxy-1,3-propylene and isopropylene; cycloalkylene such as cyclohexylene; arylene such as phenylene, arylene substituted with hydrophilic polar groups such as

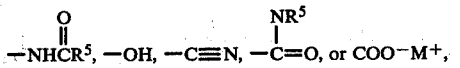

wherein $R^5$ is lower alkyl such as methyl or ethyl and $M^+$ is as defined below; arylenealkylene such as phenylenemethylene, phenylenethylene, phenylenepropylene, and phenylenebutylene; and arylenebisalkylene such as phenylenedimethylene; the alkylene portion of the arylenealkylene or arylenebisalkylene has from 1 to about 6 carbon atoms;

$R^2$, $R^3$ and $R^4$ are independently hydrogen, alkyl preferably having from 1 to 6 carbon atoms such as methyl, ethyl, propyl, isopropyl or butyl, or are taken together with N to form a nitrogen containing heterocyclic group optionally containing S or O, such as pyridinium, imidazolium, oxazolium, thiazolium and morpholinium;

$X^\ominus$ is an acid anion such as chloride, bromide, acetate, p-toluenesulfonate, methanesulfonate, ethanesulfonate, methyl sulfate, ethyl sulfate or perchlorate; and $M^+$ is hydrogen; a metal ion such as sodium, potassium, or other soluble cation, or an ammonium group including quaternary ammonium cations having alkyl groups of less than 6 carbon atoms; and (2) from about 30 to about 90 percent by weight of at least one other polymerized copolymerizable ethylenically unsaturated monomer, preferably one or a mixture of monomers having cross-linkable groups such as 2-hydroxyethyl methacrylate, 2-hydroxyethyl acrylate and active methylene group-containing monomers such as described in U.S. Pat. Nos. 3,459,790; 3,488,708; 3,554,987; 3,658,878; 3,929,482 and 3,939,130.

Examples of monomers from which recurring units (I) and (II) are derived include:

N-(2-acryloyloxyethyl)-N,N,N-trimethylammonium chloride;

N-(2-hydroxy-3-methacryloyloxypropyl)-N,N,N-trimethylammonium chloride;

N-(3-acrylamidopropyl)pyridinium chloride;

N-(2-hydroxy-3-methacryloyloxypropyl)-N,N,N-trimethylammonium chloride;

N-(2-hydroxy-3-methacryloyloxypropyl)-N,N,N-trimethylammonium sulfate;

N-(2-methacryloyloxyethyl)-N,N,N-trimethylammonium iodide;

N-(2-methacryloyloxyethyl)-N,N,N-trimethylammonium p-toluene sulfonate;

N-(2-methacryloyloxyethyl)-N,N,N-trimethylammonium methosulfate;

N-(2-methacryloyloxyethyl)-N,N,N-trimethylammonium acetate;

N-(2-methacryloyloxyethyl)-N,N,N-trimethylammonium bromide;

N-(2-methacryloyloxyethyl)-N,N,N-trimethylammonium chloride;

N-(2-methacryloyloxyethyl)-N,N,N-trimethylammonium ethyl sulfonate;

N-(2-methacryloyloxyethyl)-N,N,N-trimethylammonium nitrate;

N-(2-methacryloyloxyethyl)-N,N,N-trimethylammonium phosphate;

N-(3-acrylamido-3,3-dimethylpropyl)-N,N,N-trimethylammonium methosulfate;

N-vinylbenzyl-N,N,N-trimethylammonium chloride;

N-benzyl-N,N-dimethyl-N-vinylbenzylammonium chloride;

N,N,N-trihexyl-N-vinylbenzylammonium chloride;

N-(2-aminoethyl)methacrylamide hydrochloride;

2-aminoethyl methacrylate hydrochloride;

N-(3-aminopropyl)methacrylamide hydrochloride;

4-(N,N-diethylamino)-1-methylbutyl acrylate hydrochloride;

2-(N,N-diethylamino)ethyl acrylate hydrochloride;

2-(N,N-diethylamino)ethyl methacrylate hydrochloride;

3-(N,N-diethylamino)propyl acrylate hydrochloride;

N-(1,1-dimethyl-3-dimethylaminopropyl)acrylamide hydrochloride;

2-(N,N-dimethylamino)ethyl acrylate hydrochloride;

2-(N,N-dimethylamino)ethyl methacrylate hydrochloride;

N-(2-dimethylaminoethyl)acrylamide hydrochloride;

N-(2-dimethylaminoethyl)methacrylamide hydrochloride;

3-(N,N-dimethylamino)propylacrylamide hydrochloride;

sodium 4-acryloyloxybutane-1-sulfonate;

sodium 3-acryloyloxybutane-1-sulfonate;

sodium 3-acryloyloxypropane-1-sulfonate;

sodium 2-acrylamido-2-methylpropanesulfonate;

sodium 3-acrylamidopropane-1-sulfonate;

sodium 2-methacryloyloxyethyl-1-sulfonate;

sodium acryloyloxymethylsulfonate;

sodium 4-methacryloyloxybutane-1-sulfonate;

sodium 2-methacryloyloxyethane-1-sulfonate;

sodium 3-methacryloyloxypropane-1-sulfonate;

sodium 2-acrylamidopropane-1-sulfonate;

sodium 2-methacrylamido-2-methylpropane-1-sulfonate; and sodium 3-acrylamido-3-methylbutane-1-sulfonate.

In the most preferred embodiment, the polymers of this invention comprise from about 10 to about 70 percent by weight of recurring units derived from monomers selected from the group consisting of:

2-aminoethyl methacrylate hydrochloride;

N-(2-methacryloyloxyethyl)-N,N,N-trimethylammonium chloride;

N-(2-methacryloyloxyethyl)-N,N,N-trimethylammonium methosulfate;

sodium 2-methacryloyloxyethyl-1-sulfonate; and 2-(N,N-dimethylamino)ethyl methacrylate hydrochloride.

The acid addition salts conforming to structure (I) are converted to the free amines when neutralized with base.

The polymers useful herein are prepared by a conventional polymerization reaction of appropriate monomers in aqueous solution.

Monomers of group (I) are prepared by methods described in *Functional Monomers* edited by R. H. Yocum and E. B. Nyquist, Marcel Dekker, Inc., New York, N.Y. (1974) and U.S. Pat. No. 2,780,604, the disclosures of which are hereby incorporated by reference. Monomers in group (II) are prepared by methods described in U.S. Pat. Nos. 3,024,221 and 3,506,707, the disclosures of which are hereby incorporated by reference.

Alternatively, the cationic polymers of the invention can be prepared by quaternization of polymers having amine groups with an alkylating agent, or reaction of an amine with polymers having groups reactive with the amine such as active halogen groups. Such techniques are well known in the art and are illustrated in U.S. Pat. Nos. 3,488,706 and 3,709,690 and Canadian Pat. No. 601,958.

The support for the bleach-fix sheet is any material which retains dimensional stability with the bleach-fix composition over a wide range of temperatures. Examples of useful supports are paper, polyolefins such as polyethylene or polypropylene, polycarbonates, cellulose acetate, cellulose acetate butyrate, poly(ethylene terephthalate) and the like. The preferred support material is poly(ethylene terephthalate).

The support contains thereover, in a layer or layers, a metallic-silver bleaching agent. Any conventional metallic-silver bleaching agent can be used. These bleaching agents are conventional in the art and described, for example, in U.S. Pat. Nos. 1,315,464, 1,946,640 and in Chapter 30 of *Photographic Chemistry,* Vol. II, P. Glafkides, Foundation Press, London, England. These bleaching agents effectively oxidize and solubilize the photographic silver image. Examples of useful silver bleaching agents described in the art include alkali metal dichromate such as sodium bichromate, potassium dichromate, an alkali metal ferricyanide such as potassium ferricyanide, sodium ferricyanide and the like.

Preferred bleaching agents are soluble in water and include ninhydrin, indandione, hexaketocyclohexane, 3,4-dinitrobenzoic acid, benzoquinone, benzene, sulfonic acid and 2,5-dinitrobenzoic acid. Especially preferred bleaching agents include metal organic complexes, for example, derivatives of ferric cyclohexyldiaminotetraacetic acid and ferric ethylenediaminetetraacetic acid, ferric citrates and the like. Generally, the bleaching agent used depends on the particular element and process employed, pH, solubility, hue, reactivity and the like.

The amount of bleaching agent used in the bleach-fix sheet varies widely, but it is preferred to use a coverage of from about 1.0 to about 100 mmol/$m^2$.

The fixing agent used is any conventional silver halide complexing agent which either dissolves and removes the silver ion from the emulsion layer or which stabilizes the silver ion to render it transparent and insensitive to light.

The complexing agent employed herein, in one form, is the conventional silver halide solvent. Silver halide solvents are defined as compounds which, when employed in an aqueous solution (60° C.), are capable of dissolving more than 10 times the amount (by weight) of silver halide which can be dissolved in water at 60° C.

Useful silver halide solvents include water-soluble thiosulfates (e.g. sodium thiosulfate, potassium thiosulfate, ammonium thiosulfate and the like), thiourea, ethylenethiourea, a water-soluble thiocyanate (e.g., sodium thiocyanate, potassium thiocyanate and ammonium thiocyanate) and a water-soluble sulfur-containing dibasic acid. Water-soluble diols used to advantage include those having the formula $HO(CH_2CH_2Z)_pCH_2CH_2OH$, wherein p is an integer of from 2 to 13 and Z represents oxygen or sulfur atoms such that at least one-third of the Z atoms are sulfur and there are at least two consecutive Z's in the structure of the compound which are sulfur atoms. The diols advantageously used are also included in compounds having the formula $HO(—CH_2CH_2X)_{c-1}(—CH_2CH_2X^1)_{d-1}(—CH_2CH_2X)_{e-1}(CH_2CH_2X^1)_{f-1}(CH_2CH_2X)_{g-1}—CH_2CH_2OH$, wherein X and $X^1$ represent oxygen or sulfur, such that when X represents oxygen, $X^1$ represents sulfur, and when X represents sulfur, $X^1$ represents oxygen, and each of c, d, e, f and g represents an integer of from 1–15, such that the sum of c+d+e+f+g represents an integer of from 6 to 19, and such that at least one-third of the total of all the X's plus all the $X^1$'s represents sulfur atoms and at least two consecutive X's and/or $X^1$'s in the structure of the compound are sulfur atoms.

Typical diols include the following:

(1) 3,6-dithia-1,8-octanediol $HOCH_2CH_2SCH_2CH_2SCH_2CH_2OH$;

(2) 3,6,9-trithia-1,11-undecanediol $HOCH_2CH_2SCH_2CH_2SCH_2CH_2SCH_2CH_2OH$;

(3) 3,6,9,12-tetrathia-1,14-tetradecanediol $HO(CH_2CH_2S)_4CH_2CH_2OH$;

(4) 9-oxa-3,6,12,15-tetrathia-1,17-heptadecanediol $HO(CH_2CH_2S)_2CH_2CH_2O(CH_2CH_2S)_2CH_2CH_2OH$;

(5) 9,12-dioxa-3,6,15,18-tetrathia-1,20-eicosanediol $HO(CH_2CH_2S)_2(CH_2CH_2O)_2(CH_2CH_2S)_2(CH_2CH_2OH)$;

(6) 3,6-dioxa-9,12-dithia-1,14-tetradecanediol $HO(CH_2CH_2O)_2(CH_2CH_2S)_2CH_2CH_2OH$;

(7) 3,12-dioxa-6,9-dithia-1,14-tetradecanediol $HOCH_2CH_2O(CH_2CH_2S)_2CH_2CH_2OCH_2CH_2OH$;

(8) 3,18-dioxa-6,9,12,15-tetrathia-1,20-eicosanediol $HOCH_2CH_2O(CH_2CH_2S)_4CH_2CH_2OCH_2CH_2OH$;

(9) 12,18-dioxa-3,6,9,15,21,24,27-heptathia-1,29-nonacosanediol $HO(CH_2CH_2S)_3CH_2CH_2OCH_2CH_2SCH_2CH_2O(CH_2CH_2S)_3CH_2CH_2OH$; and

(10) 3,12,21-trioxa-6,9,15,18-tetrathia-1,23-tricosanediol $HOCH_2CH_2O(CH_2CH_2S)_2CH_2CH_2O(CH_2CH_2S)_2CH_2CH_2OCH_2CH_2OH$.

Water-soluble sulfur-containing dibasic acids which are useful include those having the formula $HOOCCH_2(SCH_2CH_2)_qSCH_2COOH$, in which q represents an integer of from 1 to 3, and the alkali metal and ammonium salts of said acids. Typical illustrative examples include:

(1) ethylene-bis-thioglycolic acid $HOOCCH_2SCH_2CH_2SCH_2COOH$;

(2) 3,6,9-trithiahendecanedioic acid $HOOCCH_2(SCH_2CH_2)_2SCH_2COOH$;

(3) 3,6,9,12-tetrathiatetradecanedioic acid $HOOCCH_2(SCH_2CH_2)_3SCH_2COOH$;

(4) ethylene-bis-thioglycolic acid disodium salt;

(5) ethylene-bis-thioglycolic acid dipotassium salt;

(6) ethylene-bis-thioglycolic acid diammonium salt;

(7) 3,6,9-trithiahendecanedioic acid disodium salt; and (8) 3,6,9,12-tetrathiatetradecanedioic acid disodium salt.

The fixing agent generally need only be compatible with the hydrophilic binder material. Particularly preferred fixing agents include: 5-(2-hydroxyethyl)tetrahydro-s-triazine-2(1H)thione; thioacetamide; 1,3-(di-2-hydroxyethyl)imidazoline-2-thione; imidazoline-2-thione; 1-methylimidazoline-2-thione; 4-methylimidazoline-2-thione; 4-hydroxymethylthiazoline-2-thione; imidazole-2-thione; S,S-di-2-hydroxyethylethane thiol; 5-(2-sulfoethyl)hexahydro-1,3,5-triazine-2-thione ammonium salt; and 5-(2-carboxyethyl)hexahydro-1,3,5-triazine-2-thione and the like.

The fixing agent is present in the bleach-fix sheet in any amount but is preferably present in a coverage of from about 1 to about 100 mmole/$m^2$.

It is preferred that the hydrophilic binder have a swelling rate $t_{\frac{1}{2}}$ greater than 5 seconds. The swelling rate of the binder is measured by any method known in the art, such as the use of a swellometer of the type described in *J. Photo. Sci.*, 20, pp. 205–210 by A. Green and G.I.P. Levenson.

A swelling rate $t_{\frac{1}{2}}$ greater than 5 seconds results in the reactions in the emulsion layers proceeding before water is removed by the cover sheet.

The binder is hardened to a swelling rate $t_{\frac{1}{2}}$ of greater than 5 seconds by either adding a hardener to the binder or by using a binder which itself is hardened.

If the hydrophilic binder is hardened with a separate hardener, the hardener is added to any conventional hydrophilic binder.

Hydrophilic binders generally useful include, for example, gelatin, poly(vinyl alcohol), poly(acrylic acid), aldehyde-containing polymers such as described in U.S. Pat. No. 3,625,694; polymers containing active methylene groups such as described in U.S. Pat. Nos. 3,459,790; 3,488,708; 3,554,987; 3,658,878; 3,929,482 and 3,939,130. Polymeric hardeners useful in combination with proteinaceous binders such as gelatin include polymers containing aziridinyl units such as described in U.S. Pat. No. 3,671,256; polymers with carboxyl and aldehyde or maleimido groups such as described in U.S. Pat. Nos. 3,306,750; 3,296,155; 3,308,075; 3,227,030 and 3,330,664 and dialdehydes of polydextrose as described in U.S. Pat. No. 3,533,800.

The hardener added to the bleach-fix sheet is any conventional hardening agent. Particularly preferred hardening agents include formaldehyde, bis-(vinylsulfonylmethyl) ether and the like.

In order to harden the hydrophilic binder so that it has a swelling rate $t_{\frac{1}{2}}$ greater than 5 seconds, at least about 1 to about 10 percent by weight based on the weight of the binder of hardener must be added.

If a separate hardener is not added to the bleach-fix sheet, a polymeric binder mixture can be used to achieve the high $t_{\frac{1}{2}}$ swelling rate. Polymeric binders having this property include poly(vinyl alcohol) combined with poly(acrylic acid) and an iron complex of an ethylenediamine tetraacetic acid.

The hardened hydrophilic binders comprise from about 0.5 to about 50 g/$m^2$ of the bleach-fix sheet.

The bleach-fix sheet additionally contains addenda such as coating aids, stabilizers, mordants, sequesterants, acids and the like.

In a particularly preferred embodiment, the bleach-fix sheet contains a layer containing a mordant for dyes. The dye mordant is any conventional dye mordant capable of holding dyes useful in the photographic unit. The mordant facilitates the transfer of dye or color-forming material from the photosensitive element and aids in preventing the dye from migrating back to the emulsion sheet prior to separation of the emulsion element and the bleach-fix sheet. Useful mordants include those described in U.S. Pat. Nos. 2,882,156; 2,458,564; 3,625,694; 3,709,690; 3,898,088 and 3,958,995 and the like.

The mordant is included in the same layer as the bleaching agent, fixing agent and the hardened hydrophilic binder or is in a separate layer either over or under the layer or layers containing said ingredients.

In a preferred embodiment, certain polymers used in the layers of the invention are also capable of functioning as mordants for dyes. Such polymers, capable of mordanting dyes, comprise (1) from about 10 to about 70 percent by weight of recurring units of an ammonium compound of the structure:

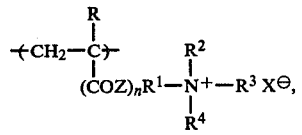

wherein R, Z, n, $R^1$, $R^2$, $R^3$, $R^4$ and $X^{\ominus}$ are as defined above; and (2) from about 30 to about 90 percent by weight of at least one other polymerized copolymerizable ethylenically unsaturated monomer.

In a further preferred embodiment, the bleach-fix sheet also contains at least one polymeric timing layer over the bleach-fix layer or layers. The polymeric timing layer(s) is capable of temporarily delaying the bleach-fix reaction until desired silver halide development and colorant or color-forming species migration has been substantially completed.

The timing layer comprises any timing layer such as gelatin, poly(vinyl alcohol), poly(vinyl alcohol)-poly(vinyl acetate) mixtures and the like such as described in U.S. Pat. No. 3,039,873, and can be barrier timing layers such as described in U.S. Pat. No. 4,056,394 issued Nov. 1, 1977 to Hannie, U.S. Pat. No. 4,061,496 issued Dec. 6, 1977 to Hannie and Ducharme and U.S. Pat. No. 4,229,516 issued Oct. 21, 1980 to Abel. The timing layer must be coated further from the support than the layer of layers containing the bleaching agent, fixing agent and hardened hydrophilic binder. Advantageously, the timing layer is coated at a thickness of at least 5–50 microns and preferably from 10 to 30 microns; however, the thickness of the timing layer is varied depending on the strength of the developer used, pH, polymeric materials used and other factors.

In a further preferred embodiment of this invention, the bleach-fix sheet also contains a polymeric acid for the purpose of lowering the pH to terminate development and/or to initiate the bleaching and fixing reactions. The polymeric acid is present in any layer of the bleach-fix sheet. Examples of polymeric acids useful herein include poly(acrylic acid), poly(n-butyl acrylate-co-acrylic acid), poly(styrene sulfonic acid), poly(vinyl hydrogen phthalate), poly(methacrylic acid), poly(-methyl vinyl ether-co-maleic anhydride) and other neutralizing materials such as disclosed in *Research Disclosure,* July 1974, No. 12331 and the like.

The bleach-fix sheet is prepared by coating a support material by any conventional coating method with a layer or layers comprising the bleaching agent, the fixing agent are hardened hydrophilic binder, generally in aqueous solution and overcoating with the water reservoir layer comprising the water-supplying polymer. Optionally, an acid layer and/or a timing layer is coated between the bleach-fix layer and the water reservoir layer. The bleach-fix sheet can be any thickness but it is preferred to use a sheet having a total thickness from about 25 to 250 microns (excluding support).

A most preferred bleach-fix sheet comprises a support having thereon at least one bleach-fix layer comprising:

(a) 5-(2-hydroxyethyl)tetrahydro-s-triazine-2-(1H)thione;
(b) 2,5-dinitrobenzoic acid and
(c) gelatin hardened with bis(vinylsulfonyl-methyl) ether to a swelling rate $t_{\frac{1}{2}}$ greater than 5 seconds; and at least one polymeric timing layer which temporarily delays the bleaching and fixing reaction, said bleach-fix sheet having at least one water reservoir layer over said polymeric timing layer or layers comprising a water-supplying polymer, said water-supplying polymer having a water uptake of at least 30 g water/g polymer and comprising:

(1) from about 10 to about 70 percent by weight of recurring units derived from 2-aminoethyl methacrylate hydrochloride and
(2) from about 30 to about 90 percent by weight of recurring units derived from 2-hydroxy-ethyl acrylate.

Generally, the bleach-fix sheet is used to remove the silver and silver halide from conventional photographic elements containing photosensitive silver halide emulsions having associated therewith a color providing material such as a dye-forming color coupler such as phenols, naphthols, pyrazolones, open-chain ketomethylenes and the like. In this process, the imagewise exposed element is developed in a processing solution containing a primary aromatic amine color developer such as 4-amino-3-methyl-N-ethyl-N-$\beta$-(methanesulfonamide)ethylanilino sulfate hydrate; 4-amino-3-methyl-N,N-diethylaniline hydrochloride, and the like to form a dye image. The element is then treated by contacting it with the bleach-fix sheet of this invention.

The bleach-fix sheet is useful to remove the silver and silver halide from any photographic element, but is particularly useful in a color image-transfer process wherein an image retained in the initially photosensitive element is used.

A process for producing a color image according to this invention comprises:

(a) developing under alkaline conditions with a silver halide developing agent an imagewise-exposed photosensitive element comprising a transparent or opaque support having thereon at least one photosensitive, silver halide emulsion layer, each silver halide emulsion layer having associated therewith a dye image-providing material preferably comprising a nondiffusible sulfonamidoaniline or a sulfonamidophenol which is alkali-cleavable upon oxidation to release a diffusible color-providing moiety from the benzene nucleus;
(b) said developing agent thereby becoming oxidized as a function of said development;
(c) the oxidized developing agent thereby cross-oxidizing each alkali-cleavable compound to cause the compound to cleave, thus forming an imagewise distribution of diffusible color-providing moiety as a function of the imagewise exposure of each of the silver halide emulsion layers;
(d) causing each imagewise distribution of diffusible color-providing moiety to diffuse out of the element; and
(e) removing residual silver and silver halide from the element using the bleach-fix sheet, whereby a color image is obtained in said element comprising residual nondiffusible compound.

It is seen that the above process provides a color image in two basic steps. The first step comprises development with a black-and-white developing agent. The second step comprises removal of the diffusible color-providing moiety along with residual silver and silver halide from the element. Of course, wash steps may be employed in the process where appropriate.

If a negative-working silver halide emulsion is employed in the photosensitive element, then a positive color image, such as a color transparency or motion picture film, is produced. If a direct-positive silver halide emulsion is employed in the photosensitive element, then a negative color image is produced.

The image former can be initially mobile dye-providing compounds, as well as initially immobile dye-providing compounds. Initially mobile dye-providing compounds are described in, for example, U.S. Pat. Nos. 3,563,739; 2,543,691; 3,705,184; 2,983,606; 3,482,972; 3,255,001 and 2,774,668. Examples of initially immobile dye-providing compounds are those described in U.S. Pat. Nos. 3,698,897; 3,725,062; 3,227,550; 3,443,939; 3,980,479; 4,055,428 and 4,076,529; British Pat. No. 1,489,695 and U.S. Application Ser. No. 326,628 and the like.

The image dye-providing materials useful with the silver halide emulsions may also be represented by the following formula:

$$\begin{array}{c} \text{Car—Link—Col} \\ | \\ \text{Ballast} \end{array}$$

wherein:

(1) Col preferably is a dye, dye precursor or other color-forming material;
(2) Ballast is an organic ballasting radical of such molecular size and configuration as to render said alkali-cleavable compound nondiffusible during development in an alkaline processing composition;
(3) Link is a redox-sensitive divalent linking group for the carrier and the color-forming material such as $NHSO_2$ and the like; and (4) Car is an oxidizable acyclic, carbocyclic or heterocyclic moiety such as described in *Research Disclosure* 15157, Volume 151.

In one embodiment, the color-forming material preferably has the formula:

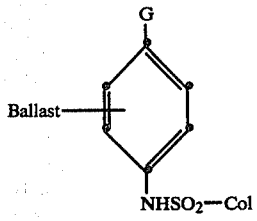

wherein:

G is OR or $NHR_1$;

R is hydrogen or a hydrolyzable moiety;

$R_1$ is hydrogen or an alkyl group; and

Ballast and Col are as described above.

In the formula listed above for compounds which are alkali-cleavable upon oxidation, R is preferably hydrogen or any hydrolyzable entity well-known to those skilled in the art, e.g., acetyl, mono-, di- or trichloroacetyl radicals, perfluoroacyl, pyruvyl, alkoxyacyl, nitrobenzoyl, cyanobenzoyl, sulfonyl, sulfinyl, etc.

In the above formula, $R_1$ is preferably hydrogen or an alkyl group, including a substituted alkyl group, of from 1 to 22 carbon atoms which optionally serves as the ballast group indirectly attached to the ring as defined below.

The nature of the ballast group is not critical as long as it confers nondiffusibility to the compounds. Useful ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms and may comprise a polymer backbone or a dye or dye precursor (Col) as defined below, e.g.:

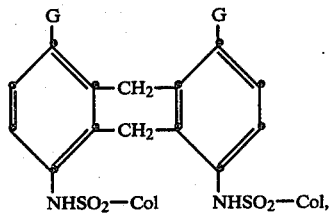

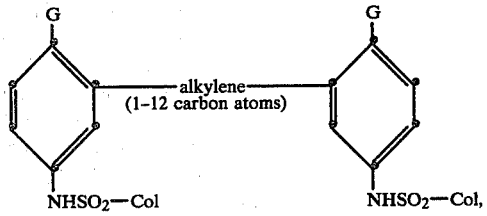

etc., wherein G and Col have the same definitions as in the formula above.

In addition to Ballast, the benzene nucleus in the above formula optionally has groups attached thereto such as halogens, alkyl, aryl, alkoxy aryloxy, nitro, amino, alkylamino, arylamino, amido, cyano, alkylmercapto, keto, carboalkoxy, etc. Such groups may combine together with the carbon atoms to which they are attached on the ring to form another ring which is saturated or unsaturated including a carbocyclic ring, a heterocyclic ring, etc.

As previously mentioned, Col in the above formula represents a dye or dye precursor or other color-forming materials. Such compounds are well known to those skilled in the art and include dyes such as azo, azomethine, indoaniline, indophenol, anthraquinone, triarylmethane, merocyanine, nitro, quinoline, cyanine, indigoide, phthalocyanine, etc., and dye precursors such as a leuco dye, a "shifted" dye which shifts hypsochromically or bathochromically when subjected to a different environment such as a change in pH, reaction with a material to form a complex, etc., couplers such as a phenol, naphthol, indazoline, open-chain benzoyl acetanilide, pivalylacetanilide, malonamide, malonanilide, cyanoacetyl, coumarone, pyrazolone and compounds described in U.S. Pat. No. 2,756,142.

When dye precursors are employed in this process instead of dyes, they are converted to dyes by means well-known to those skilled in the art, either in the photosensitive element or in the processing composition, to form a visible dye. Such techniques are disclosed, for example, in British Pat. Nos. 1,157,501, 1,,157,502, 1,157,503, 1,157,504, 1,157,505, 1,157,506, 1,157,507, 1,157,508, 1,157,509 and 1,157,510 and U.S. Pat. Nos. 2,774,668, 2,698,798, 2,698,244, 2,661,293 and 2,559,653.

This invention is used to produce positive or negative images in single- or multicolors. In a three-color system, each silver halide emulsion layer of the photosensitive element has associated therewith a dye image-providing material possessing a spectral absorption range substantially complementary to the predominant sensitivity range of its associated emulsion, i.e., the blue-sensitive silver halide emulsion layer has a yellow dye image-providing material associated therewith, the green-sensitive silver halide emulsion layer has a magenta dye image-providing material associated therewith, and the red-sensitive silver halide emulsion layer has a cyan dye image-providing material associated therewith. The dye image-providing material associated with each silver halide emulsion layer is contained in either the silver halide emulsion layer itself or a layer contiguous the silver halide emulsion layer.

The concentration of the alkali-cleavable compounds that are employed in the present invention vary over a wide range depending upon the particular compound employed and the results desired. For example, alkali-cleavable dye image-providing compounds of the present invention are coated in layers by using coating solutions containing between about 0.5 and about 8 percent by weight of the dye image-providing compound distributed in a hydrophilic film-forming natural material or synthetic polymer, such as gelatin, poly(vinyl alcohol), etc., which is adapted to be permeated by aqueous alkaline processing composition.

Any silver halide developing agent is employed in this invention, as long as it crossoxidizes with the alkali-cleavable compounds described herein. The developer may be employed in the photosensitive element to be activated by an alkaline processing composition. Specific examples of such developers employed in this invention include:

hydroquinone,

N-methylaminophenol, phenidone (1-phenyl-3-pyrazolidone), dimezone (1-phenyl-4,4-dimethyl-3-pyrazolidone),
4-hydroxymethyl-4-methyl-1-phenyl-3-pyrazolidone and
N,N,N',N'-tetramethyl-p-phenylenediamine.

These materials are employed in an alkaline solution and optionally contain conventional addenda well-known to those skilled in the photographic art.

As was mentioned previously, the silver halide developer in this process becomes oxidized upon development and reduces silver halide to silver metal. The oxidized developer then crossoxidizes the alkali-cleavable compound, causing it to cleave, thus forming an imagewise distribution of diffusible dye or dye precursor which then diffuses out of the element. The diffusible moiety is transferable in alkaline processing composition either by virtue of its self-diffusivity or by having attached to it one or more solubilizing groups such as —COOH, —$SO_3H$, —$CONH_2$, —$SO_2NHX$, —CONHX where X is aryl or alkyl, —OH or —SH.

The silver halide emulsions useful in this invention are well-known to those skilled in the art and are described in *Product Licensing Index,* Vol. 92, December, 1971, publication 9232, page 107, paragraph I, "Emulsion types"; they may be chemically and spectrally sensitized as described on page 107, paragraph III, "Chemical sensitization" and pages 108–109, paragraph IV, "Spectral sensitization" of the above article; they can be protected against the production of fog and can be stabilized against loss of sensitivity during keeping by employing the materials described on page 107, paragraph V, "Anti-foggants and stabilizers" of the above article; they can contain development modifiers, hardeners and coating aids as described on pages 107–108, paragraph IV, "Development modifiers", paragraph VII, "Hardeners" and paragraph XII, "Coating aids" of the above article; they and other layers in the photographic elements used in this invention can contain the vehicles described on page 108, paragraph VIII, "Vehicles" of the above article; they may be coated on any of the transparent supports described on page 108, paragraph X, "Supports" of the above article; and they can be coated by using the various techniques described on page 109, paragraph XVIII, "Coating procedures" of the above article; the disclosures of which are hereby incorporated by reference.

The process is carried out in any of a variety of ways. In one embodiment, the element containing the silver halide is placed over the bleach-fix sheet with a means for discharging processing composition between the emulsion sheet and the bleach-fix sheet. The composite is then exposed and the bleach-fix sheet is pressed to the emulsion layer, thus releasing the processing composition to develop the emulsion layer imagewise. If the timing layer is present in the bleach-fix sheet, the processing is complete when the bleach-fix reactions take effect to provide the retained color image in the emulsion layer. The bleach-fix sheet is then removed from the emulsion-containing element and the positive or negative image is retained in color in the emulsion layer. If desired, the corresponding negative or positive image is used on the bleach-fix sheet if the bleach-fix sheet contains a mordant layer to retain this transferred dye image.

Alternatively, and in the preferred embodiment, the light-sensitive element is first exposed and dipped in a processing composition and then contacted with the bleach-fix sheet and subsequently separated from the bleach-fix sheet to leave a retained image in the emulsion element. Optionally, the bleach-fix sheet is soaked in the processing composition prior to contact with the element. If the support for the emulsion element is transparent, a transparency is achieved, and if the support for the emulsion is opaque, a reflection print is obtained.

It is noted that the term "in association with" used throughout the specification and claims means that the silver halide emulsion and the image-forming material are either in the same layer or in contiguous layers or close to each other such that the development of the silver halide would oxidize the carrier of the image-forming material.

The bleach-fix sheets of this invention comprising a water-supplying polymer provide a means for increasing the uptake and release of aqueous activator solution into the laminated structure, thereby solving the starvation problem. Consequently, the imaging process is more complete resulting in improved image discrimination. Satisfactory results were not attainable using bleach-fix solutions or bleach-fix sheets without the water reservoir layers comprising the water-supplying polymers of the invention.

The following examples further illustrate the invention.

EXAMPLE 1

Bleach-Fix Cover Sheet With Acid Layer in a Soak and Laminate Process

A bleach-fix cover sheet was prepared comprising a poly(ethylene terephthalate) film support having coated thereon:

(1) A bleach-fix layer containing 5-(2-hydroxyethyl)-tetrahydro-s-triazine-2(1H)thione at 1.80 g/ft$^2$ (19.4 g/m$^2$), triethanolammonium ferric ethylenediaminetetraacetic acid at 1.10 g/ft$^2$ (11.9 g/m$^2$), compound A* at 0.30 g/ft$^2$ (3.24 g/m$^2$) and gelatin at 2.0 g/ft$^2$ (21.6 g/m$^2$).

(2) A timing layer containing poly(vinyl-acetal phthalate) at 0.90 g/ft$^2$ (9.72 g/m$^2$).

(3) A water reservoir layer containing poly[N-(2-methacryloyloxyethyl)-N,N,N-trimethylammonium chloride-co-2-hydroxyethyl acrylate], weight ratio 20:80, at 0.50 g/ft$^2$ (5.4 g/m$^2$) and formaldehyde at 0.20 g/ft$^2$ (2.2 g/m$^2$).

Preparation of Poly[N-(2-methacryloyloxyethyl)-N,N,N-trimethylammonium chloride-co 2-hydroxyethyl acrylate] (Weight ratio 20:80)

To a 5-liter flask equipped with a stirrer and condenser was added 3300 ml of distilled water, 250 g of ethyl alcohol, 133 g of 60% aqueous solution of N-(2-methacryloyloxyethyl)-N,N,N-trimethylammonium chloride and 320 g of 2-hydroxyethyl acrylate. The solution was degassed with nitrogen and then warmed to 60° C. To this solution was added 4.0 g of 4,4'-azobis(4-cyanovaleric acid) (65%) and the solution was stirred at 60° C. under nitrogen for 16 hours. The clear, viscous solution was cooled and dialyzed for 7 hours giving a solution containing 8.0% solids with a Brookfield viscosity of 150 cps.

A multilayer color photographic element using sulfonamidonaphthol redox dye release (RDR) chemistry and negative-working emulsions adapted for a retained-image process was prepared according to the following schematic structure.

Gelatin; Bis(vinylsulfonylmethyl) ether

Blue-sensitive AgX; Gelatin; RDR B* dissolved in N,N—diethyllauramide

Gelatin

Green-sensitive AgX; Gelatin; RDR C* dissolved in N,N—diethyllauramide

Gelatin

Red-sensitive AgX; Gelatin; RDR D* dissolved in N,N—diethyllauramide

Poly(ethylene terephthalate)

*Compound Identification

Compound A: Poly(styrene-co-3-acrylamidopropyl-trimethylammonium p-toluene sulfonate)

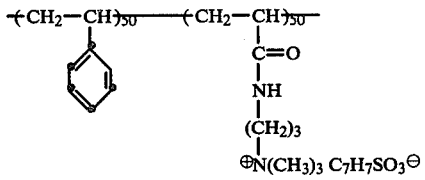

RDR B (Yellow dye-releasing compound):

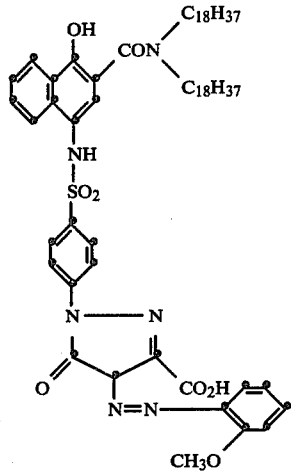

RDR C (Magenta dye-releasing compound):

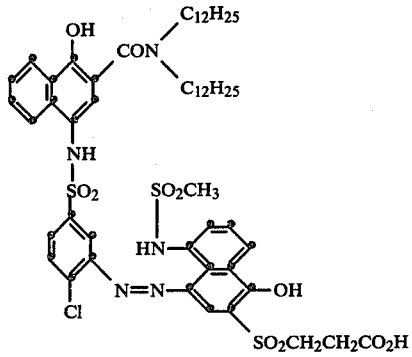

RDR D (Cyan dye-releasing compound):

-continued

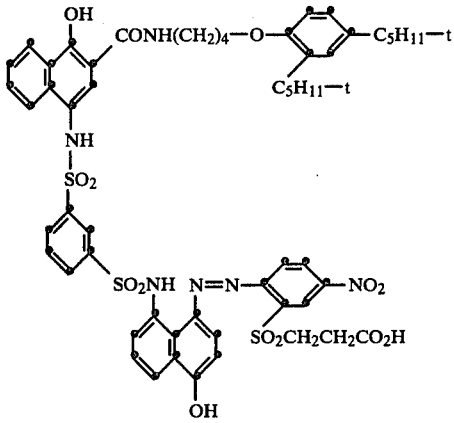

Three samples of the multilayer color photographic element prepared above were exposed in a sensitometer to yield a near-neutral image at a mid-scale density of approximately 1.0.

Each sample was then soaked for 60 seconds in activator solution of the following composition:

| | |
|---|---|
| $Na_3PO_4.12H_2O$ (0.25M) | 95 g |
| KBr | 2.5 g |
| $Na_2SO_3$ | 2.0 g |
| 4-Hydroxymethyl-4-methyl-1-phenyl-3-pyrazolidone | 0.3 g |
| 11-Aminoundecanoic acid | 10.0 g |
| Benzyl alcohol | 10.0 ml |
| Hydroxyethyl cellulose | 5.0 g |

per liter of water.

Sample 1 was subsequently laminated to a control unsoaked sample of a bleach-fix cover sheet which did not contain a water reservoir overcoat layer, using a pair of juxtaposed pressure rollers in the absence of light. Sample 2 was laminated to an unsoaked sample of the above-described bleach-fix cover sheet. Sample 3 was laminated to a sample of the above-described bleach-fix cover sheet which had been soaked in activator solution for 15 seconds.

After 10 minutes, the laminated units were separated. The sample processed with the control bleach-fix cover sheet which did not contain a water reservoir overcoat layer revealed an insufficient amount of activator solution was supplied to the laminated structure to accomplish imaging chemistry, bleach-fix chemistry and dye diffusion to the cover sheet. These samples processed with bleach-fix sheets not containing the water reservoir layer yielded a lower $D_{max}$ indicating the presence of residual silver which caused the images to appear dull with dark desaturated colors. Samples processed with a bleach-fix cover sheet of the invention revealed well-defined position color transparencies. Infrared density of the $D_{min}$ area was 0.05, indicating that substantially all of the developed silver had been bleached. It was further apparent from the quality of the prints ($D_{min}$, $D_{max}$) that imaging (development, dye release and dye removal), as well as bleaching and fixing was substantially complete.

The invention has been described in detail with particular reference to preferred embodiments thereof, but it will be understood that variations and modifications can be effected within the spirit and scope of the invention.

What is claimed is:

1. A bleach-fix sheet comprising a support having thereon at least one bleach-fix layer for supplying a bleach-fix composition in a photographic element, said bleach-fix sheet having over said bleach-fix layer or layers, a water reservoir layer comprising a water-supplying polymer, said polymer comprising:

(1) from about 10 to about 70 percent by weight of recurring units having the formula selected from the group consisting of:

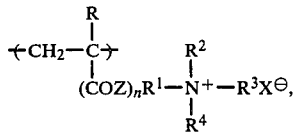

(I)

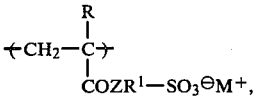

(II)

and a mixture of I and II, wherein:

R is hydrogen, methyl or halogen;

Z is oxy or imino;

n is 0 or 1;

$R^1$ is alkylene, cycloalkylene, arylene, arylenealkylene or arylenebisalkylene, the alkylene portions of which comprise from 1 to 6 carbon atoms;

$R^2$, $R^3$ and $R^4$ are independently hydrogen, alkyl or are taken together with N to form a nitrogen containing heterocyclic group;

$X^{\ominus}$ is an acid anion; and $M^+$ is hydrogen, a metal ion or ammonium; and (2) from about 30 to about 90 percent by weight of polymerized units of at least one other copolymerizable ethylenically unsaturated monomer, said polymer having a water uptake of at least about 30 g water/g polymer when a weighed polymer sample coating is dipped in water for 10 seconds and thereafter reweighed, said bleach-fix sheet comprising in addition to said water reservoir layer a layer containing a mordant for dyes.

2. The bleach-fix sheet of claim 1 wherein:

$R^1$ is alkylene having from 1 to 6 carbon atoms or arylene;

$R^2$ is hydrogen or an alkyl group having from 1 to 4 carbon atoms; and $R^3$ and $R^4$ are hydrogen.

3. The bleach-fix sheet of claim 1 wherein said polymer comprises from about 30 to about 90 percent by weight of recurring units derived from monomers selected from the group consisting of 2-hydroxyethyl acrylate, a copolymerizable ethylenically unsaturated monomer containing an active methylene group, and a mixture of 2-hydroxyethyl acrylate and a polymerized copolymerizable ethylenically unsaturated monomer containing an active methylene group.

4. The bleach-fix sheet of claim 1 wherein said polymer comprises from about 10 to about 70 percent by weight of recurring units derived from monomers selected from the group consisting of:

2-aminoethyl methacrylate hydrochloride;

N-(2-methacryloyloxyethyl)-N,N,N-trimethylammonium chloride;

N-(2-methacryloyloxyethyl)-N,N,N-trimethylammonium methosulfate;

sodium 2-methacryloyloxyethyl-1-sulfonate; and 2-(N,N-dimethylamino)ethyl methacrylate.

5. The bleach-fix sheet of claim 1 wherein said polymer comprises:

(1) from about 10 to about 70 percent by weight of recurring units derived from 2-aminoethyl methacrylate hydrochloride; and (2) from about 30 to about 90 percent by weight of recurring units derived from 2-hydroxyethyl acrylate.

6. A bleach-fix sheet comprising a support having thereon at least one bleach-fix layer comprising:

(a) a metallic-silver bleaching agent, (b) a silver salt fixing agent, and (c) a hydrophilic binder, said bleach-fix sheet having thereover at least one water reservoir layer comprising a water-supplying polymer, said polymer comprising:

(1) from about 10 to about 70 percent by weight of recurring units having the formula selected from the group consisting of:

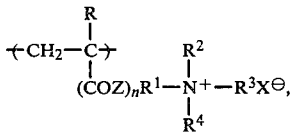

(I)

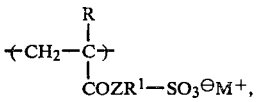

(II)

and a mixture of I and II, wherein:

R is hydrogen, methyl or halogen;

Z is oxy or imino;

n is 0 or 1;

$R^1$ is alkylene, cycloalkylene, arylene, arylenealkylene or arylenebisalkylene, the alkylene portions of which comprise from 1 to 6 carbon atoms;

$R^2$, $R^3$ and $R^4$ are independently hydrogen, alkyl or are taken together with N to form a nitrogen containing heterocyclic group;

$X^{\ominus}$ is an acid anion; and $M^+$ is hydrogen, a metal ion or ammonium; and (2) from about 30 to about 90 percent by weight of polymerized units of at least one other copolymerizable ethylenically unsaturated monomer, said polymer having a water uptake of at least about 30 g water/g polymer when a weighed polymer sample coating is dipped in water for 10 seconds and thereafter reweighed, said bleach-fix sheet comprising in addition to said water reservoir layer a layer containing a mordant for dyes.

7. The bleach-fix sheet of claim 6 wherein said metallic-silver bleaching agent is 5-(2-hydroxyethyl)tetrahydro-s-triazine(1H)thione and said silver salt fixing agent is 2,5-dinitrobenzoic acid.

8. The bleach-fix sheet of claim 6 wherein said polymer is a dye mordant.

9. A bleach-fix sheet comprising a support having thereon at least one bleach-fix layer comprising:

(a) a metallic-silver bleaching agent, (b) a silver salt fixing agent, and (c) a hydrophilic binder, having thereover at least one polymeric timing layer, said bleach-fix sheet having at least one water reservoir layer over said polymeric timing layer or layers, said water reservoir layer comprising a water-supplying polymer, said polymer comprising:

(1) from about 10 to about 70 percent by weight of recurring units having the formula selected from the group consisting of:

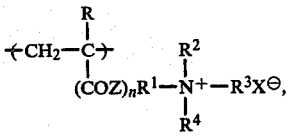

(I)

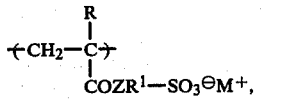

(II)

and a mixture of I and II, wherein:

R is hydrogen, methyl or halogen;

Z is oxy or imino;

n is 0 or 1;

$R^1$ is alkylene, cycloalkylene, arylene, arylenealkylene or arylenebisalkylene, the alkylene portions of which comprise from 1 to 6 carbon atoms;

$R^2$, $R^3$ and $R^4$ are independently hydrogen, alkyl or are taken together with N to form a nitrogen containing heterocyclic group;

$X^{\ominus}$ is an acid anion; and $M^+$ is hydrogen, a metal ion or ammonium; and (2) from about 30 to about 90 percent by weight of polymerized units of at least one other copolymerizable ethylenically unsaturated monomer, said polymer having a water uptake of at least about 30 g water/g polymer when a weighed polymer sample coating is dipped in water for 10 seconds and thereafter reweighed, said bleach-fix sheet comprising in addition to said water reservoir layer a layer containing a mordant for dyes.

10. A bleach-fix sheet comprising a support having thereon at least one bleach-fix layer comprising:

(a) 5-(2-hydroxyethyl)tetrahydro-s-triazine-2-(1H)-thione;

(b) 2,5-dinitrobenzoic acid; and (c) gelatin hardened with bis(vinylsulfonylmethyl) ether to a swelling rate $t_{\frac{1}{2}}$ greater than 5 seconds;

having thereover, at least one polymeric timing layer and a water reservoir layer comprising a water-supplying polymer, said water-supplying polymer having a water uptake of at least about 30 g water/g polymer when a weighed polymer sample coating is dipped in water for 10 seconds and thereafter reweighed and comprising:

(1) from about 10 to about 70 percent by weight of recurring units derived from 2-aminoethyl methacrylate hydrochloride; and (2) from about 30 to about 90 percent by weight of recurring units derived from 2-hydroxyethyl acrylate, said bleach-fix sheet comprising in addition to said water reservoir layer a layer containing a mordant for dyes.

11. A photographic film unit containing a silver halide developing agent, said film unit comprising:

(a) an element comprising a support having thereon at least one photosensitive silver halide emulsion layer having associated therewith a dye image-providing material;

(b) a bleach-fix sheet comprising a support having thereon at least one bleach-fix layer comprising:

(i) a metallic-silver bleaching agent, (ii) a silver salt fixing agent, and (iii) a hydrophilic binder, said bleach-fix sheet having thereover a water reservoir layer comprising a water-supplying polymer, said polymer comprising:

(1) from about 10 to about 70 percent by weight of recurring units having the formula selected from the group consisting of:

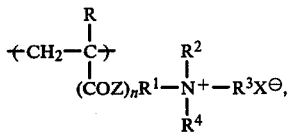

(I)

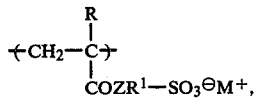

(II)

and a mixture of I and II, wherein:

R is hydrogen, methyl or halogen;

Z is oxy or imino;

n is 0 or 1;

$R^1$ is alkylene, cycloalkylene, arylene, arylenealkylene or arylenebisalkylene, the alkylene portions of which comprise from 1 to 6 carbon atoms;

$R^2$, $R^3$ and $R^4$ are independently hydrogen, alkyl or are taken together with N to form a nitrogen containing heterocyclic group;

$X^{\ominus}$ is an acid anion; and $M^+$ is hydrogen, a metal ion or ammonium; and (2) from about 30 to about 90 percent by weight of polymerized units of at least one other copolymerizable ethylenically unsaturated monomer, said polymer having a water uptake of at least about 30 g water/g polymer when a weighed polymer sample coating is dipped in water for 10 seconds and thereafter reweighed, said bleach-fix sheet comprising in addition to said water reservoir layer a layer containing a mordant for dyes; and (c) an alkaline processing composition and means for discharging same within said film unit in contact with said photosensitive layer;

wherein, upon discharge of said processing composition, said silver halide is developed imagewise, the developed metallic-silver is bleached and the silver halide is fixed.

12. The photographic film unit of claim 11 wherein said element (a) comprises a photosensitive element comprising a transparent support having thereon the following layers in sequence: an image receiving layer; an alkaline solution-permeable, light-reflective layer; an alkaline solution-permeable, opaque layer; a red-sensitive silver halide emulsion layer having a ballasted redox cyan dye image-providing material associated therewith; a green-sensitive silver halide emulsion layer having a ballasted redox magenta dye image-providing material associated therewith; and a blue-sensitive silver halide emulsion layer having a ballasted redox yellow dye image-providing material associated therewith; and said bleach-fix cover sheet (b) comprises a water reserhaving thereover at least one polymeric timing layer, said bleach-fix sheet having at least one water reservoir layer over said polymeric timing layer or layers, said water reservoir layer comprising a water-supplying polymer, said polymer comprising:

(1) from about 10 to about 70 percent by weight of recurring units having the formula selected from the group consisting of:

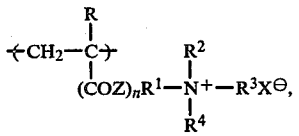

(I)

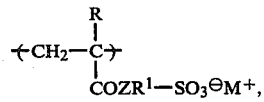

(II)

and a mixture of I and II, wherein:

R is hydrogen, methyl or halogen;

Z is oxy or imino;

n is 0 or 1;

$R^1$ is alkylene, cycloalkylene, arylene, arylenealkylene or arylenebisalkylene, the alkylene portions of which comprise from 1 to 6 carbon atoms;

$R^2$, $R^3$ and $R^4$ are independently hydrogen, alkyl or are taken together with N to form a nitrogen containing heterocyclic group;

$X^{\ominus}$ is an acid anion; and $M^+$ is hydrogen, a metal ion or ammonium; and (2) from about 30 to about 90 percent by weight of polymerized units of at least one other copolymerizable ethylenically unsaturated monomer, said polymer having a water uptake of at least about 30 g water/g polymer when a weighed polymer sample coating is dipped in water for 10 seconds and thereafter reweighed, said bleach-fix sheet comprising in addition to said water reservoir layer a layer containing a mordant for dyes.

10. A bleach-fix sheet comprising a support having thereon at least one bleach-fix layer comprising:

(a) 5-(2-hydroxyethyl)tetrahydro-s-triazine-2-(1H)-thione;

(b) 2,5-dinitrobenzoic acid; and (c) gelatin hardened with bis(vinylsulfonylmethyl)

layer having associated therewith a dye image-providing material;

(b) a bleach-fix sheet comprising a support having thereon at least one bleach-fix layer comprising:

(i) a metallic-silver bleaching agent, (ii) a silver salt fixing agent, and (iii) a hydrophilic binder, said bleach-fix sheet having thereover a water reservoir layer comprising a water-supplying polymer, said polymer comprising:

(1) from about 10 to about 70 percent by weight of recurring units having the formula selected from the group consisting of:

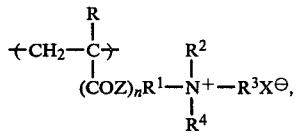

(I)

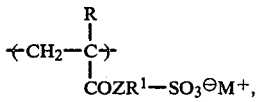

(II)

and a mixture of I and II, wherein:

R is hydrogen, methyl or halogen;

Z is oxy or imino;

n is 0 or 1;

$R^1$ is alkylene, cycloalkylene, arylene, arylenealkylene or arylenebisalkylene, the alkylene portions of which comprise from 1 to 6 carbon atoms;

$R^2$, $R^3$ and $R^4$ are independently hydrogen, alkyl or are taken together with N to form a nitrogen containing heterocyclic group;

$X^{\ominus}$ is an acid anion; and $M^+$ is hydrogen, a metal ion or ammonium; and (2) from about 30 to about 90 percent by weight of polymerized units of at least one other copolymerizable ethylenically unsaturated monomer, said polymer having a water uptake of at least about 30 g water/g polymer when a weighed polymer sample coating is dipped in water for 10 seconds and thereafter reweighed, said bleach-fix sheet comprising in addition to said water reservoir layer a layer containing a mordant for dyes; and (c) an alkaline processing composition and means for (b) a bleach-fix sheet comprising a support having thereover at least one bleach-fix layer comprising:
(i) a metallic-silver bleaching agent,
(ii) a silver salt fixing agent, and
(iii) a hydrophilic binder, said bleach-fix layer having thereover a water reservoir layer comprising a water-supplying polymer, said polymer comprising:

(1) from about 10 to about 70 percent by weight of recurring units having the formula selected from the group consisting of:

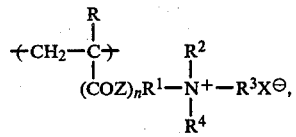

(I)

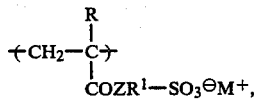

(II)

and a mixture of I and II, wherein:
R is hydrogen, methyl or halogen;
Z is only or imino;
n is 0 or 1;
$R^1$ is alkylene, cycloalkylene, arylene, arylenealkylene or arylenebisalkylene, the alkylene portions of which comprise from 1 to 6 carbon atoms;
$R^2$, $R^3$ and $R^4$ are independently hydrogen, alkyl or are taken together with N to form a nitrogen containing heterocyclic group;
$X^{\ominus}$ is an acid anion; and
$M^+$ is hydrogen, a metal ion or ammonium; and (2) from about 30 to about 90 percent by weight of polymerized units of at least one other copolymerizable ethylenically unsaturated monomer, said polymer having a water uptake of at least about 30 g water/g polymer when a weighed polymer sample coating is dipped in water for 10 seconds and thereafter reweighed, said bleach-fix sheet comprising in addition to said water reservoir layer a layer containing a mordant for dyes; and (c) an alkaline processing composition and means for discharging same within said film unit in contact with said photosensitive layer wherein the film unit contains a silver halide developing agent, said process comprising:
(i) imagewise-exposing said film unit to electromagnetic radiation,
(ii) laminating element (a) to bleach-fix sheet (b) so that the alkaline processing composition permeates the element (a) and element (a) is bleach-fixed by bleach-fix sheet (b), and
(iii) removing the bleach-fix sheet from element (a).

19. The process of claim 18 wherein said bleach-fix sheet additionally comprises between said water reservoir layer comprising a water-supplying polymer and said bleach-fix layer or layers, at least one polymeric timing layer.

20. The process of claim 18 wherein said copolymerizable ethylenically unsaturated monomer has crosslinkable groups.

21. The process of claim 18 wherein said polymer is a mordant for dyes provided by said dye image providing materials.

22. A process of producing a photographic transfer image in a photographic film comprising:

(a) imagewise-exposing a photosensitive element comprising a support having thereon at least one photosensitive silver halide emulsion layer having associated therewith a dye image-providing material;

(b) treating the exposed element with alkaline processing solution in the presence of a silver halide developing agent; and (c) contacting the element with a bleach-fix sheet comprising a support having thereon at least one bleach-fix layer comprising:
(i) a metallic-silver bleaching agent,
(ii) a silver salt fixing agent, and
(iii) a hydrophilic binder, said bleach-fix sheet having thereover a water reservoir layer comprising a water-supplying polymer, said polymer comprising:

(1) from about 10 to about 70 percent by weight of recurring units having the formula selected from the group consisting of:

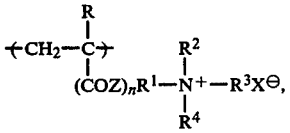

(I)

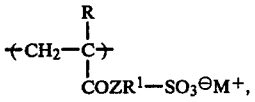

(II)

and a mixture of I and II, wherein:
R is hydrogen, methyl or halogen;
Z is oxy or imino;
n is 0 or 1;
$R^1$ is alkylene, cycloalkylene, arylene, arylenealkylene or arylenebisalkylene, the alkylene portions of which comprise from 1 to 6 carbon atoms;
$R^2$, $R^3$ and $R^4$ are independently hydrogen, alkyl or are taken together with N to form a nitrogen containing heterocyclic group;
$X^{\ominus}$ is an acid anion; and
$M^+$ is hydrogen, a metal ion or ammonium; and (2) from about 30 to about 90 percent by weight of polymerized units of at least one other copolymerizable ethylenically unsaturated monomer, said polymer having a water uptake of at least about 30 g water/g polymer when a weighed polymer sample coating is dipped in water for 10 seconds and thereafter reweighed, said bleach-fix sheet comprising in addition to said water reservoir layer a layer containing a mordant for dyes.

23. The process of claim 22 wherein said bleach-fix sheet comprises between said water reservoir layer comprising a water-supplying polymer and said bleach-fix layer or layers at least one polymeric timing layer.

24. The process of claim 22 wherein said copolymerizable ethylenically unsaturated monomer has crosslinkable groups.

* * * * *